US010756446B2

(12) United States Patent
Ahmadloo et al.

(10) Patent No.: US 10,756,446 B2
(45) Date of Patent: Aug. 25, 2020

(54) PLANAR ANTENNA STRUCTURE WITH REDUCED COUPLING BETWEEN ANTENNA ARRAYS

(71) Applicant: Veoneer US, Inc., Southfield, MI (US)

(72) Inventors: Majid Ahmadloo, Southfield, MI (US); Arnold Mobius, Southfield, MI (US)

(73) Assignee: Veoneer US, Inc., Southfield, MI (US)

( * ) Notice: Subject to any disclaimer, the term of this patent is extended or adjusted under 35 U.S.C. 154(b) by 0 days.

(21) Appl. No.: 16/039,508

(22) Filed: Jul. 19, 2018

(65) Prior Publication Data

US 2020/0028275 A1 Jan. 23, 2020

(51) Int. Cl.

| | |
|---|---|
| ***H01Q 21/06*** | (2006.01) |
| ***H01Q 1/32*** | (2006.01) |
| ***H01Q 1/38*** | (2006.01) |
| ***H01Q 1/52*** | (2006.01) |
| ***H01Q 21/00*** | (2006.01) |

(52) U.S. Cl.

CPC ..... *H01Q 21/065* (2013.01); *H01Q 1/3233* (2013.01); *H01Q 1/38* (2013.01); *H01Q 1/523* (2013.01); *H01Q 1/525* (2013.01); *H01Q 21/0025* (2013.01)

(58) Field of Classification Search

CPC .... H01Q 21/065; H01Q 1/523; H01Q 1/3233; H01Q 1/525; H01Q 1/38; H01Q 21/0025; H01Q 21/0075

See application file for complete search history.

(56) References Cited

U.S. PATENT DOCUMENTS

| | | | | |
|---|---|---|---|---|
| 7,973,718 | B2 | 7/2011 | Mak et al. | |
| 8,253,645 | B2 | 8/2012 | Derneryd et al. | |
| 9,917,355 | B1 * | 3/2018 | Lee | H01Q 1/3233 |
| 2007/0182619 | A1 * | 8/2007 | Honda | H01Q 25/02 342/80 |
| 2014/0035780 | A1 | 2/2014 | Trotta | |
| 2016/0033640 | A1 * | 2/2016 | De Mersseman | G01S 7/2813 342/70 |

FOREIGN PATENT DOCUMENTS

| | | | |
|---|---|---|---|
| EP | 3043382 | A1 | 7/2016 |

* cited by examiner

*Primary Examiner* — Hai V Tran
*Assistant Examiner* — Michael M Bouizza
(74) *Attorney, Agent, or Firm* — Burns & Levinson LLP; Steven M. Mills

(57) ABSTRACT

An antenna includes a substrate, a first array of transmit antenna patches on the substrate, and a second array of receive antenna patches on the substrate. A spatial orientation of the first array with respect to the second array is selected based on a predetermined desired radiation coupling between the first array and the second array. The antenna can be part of an automotive radar sensor.

12 Claims, 10 Drawing Sheets

PLANAR ANTENNA STRUCTURE WITH REDUCED COUPLING BETWEEN ANTENNA ARRAYS

BACKGROUND

1. Technical Field

The present disclosure is related to planar antenna structures and, more particularly, to planar antenna structures with reduced coupling between antenna arrays realized by selective positioning of one or more of the array elements.

2. Discussion of Related Art

In radar sensor modules such as automotive radar sensor modules, transmit (Tx) and receive (Rx) antenna arrays are implemented in the form of conductive patches formed on a non-conductive substrate. The substrate can include, for example, a printed circuit board (PCB), which can be made of and/or include special high-performance, high-frequency materials compatible with the high-frequency operation of the radar system in general and antenna patch arrays in particular. In a series-fed patch array, the conductive patches of each antenna array are typically connected together along a longitudinal direction by segments of conductive microstrip line formed on the substrate between adjacent antenna array patches. The antenna patches and the interconnecting segments of microstrip line, as well as associated components such as feed lines, waveguides and RF transition elements, e.g., waveguide-to-microstrip line transitions, are commonly formed by depositing metal and/or other conductive material on the surface of the substrate, e.g., PCB, in a predetermined desired pattern.

Typical automotive radar sensor modules are bistatic in that they are implemented using separate Tx and Rx antennas. In most cases, the automotive radar sensor includes two to four Rx antenna arrays and at least two Tx antenna arrays. Small size is an important requirement in the sensors. As a result, it is important to make the antenna arrays as small as possible and to space them as close together as possible. One difficulty associated with locating the Tx and Rx arrays so close together is the resulting increase in undesirable coupling between the arrays, which can substantially degrade the performance of the antennas in particular and the overall sensor as a whole.

SUMMARY

According to a first aspect, an antenna is provided. The antenna includes a substrate, a first array of transmit antenna patches on the substrate, and a second array of receive antenna patches on the substrate. A spatial orientation of the first array with respect to the second array is selected based on a predetermined desired radiation coupling between the first array and the second array.

In some exemplary embodiments, the spatial orientation is selected to reduce the radiation coupling between the first array and the second array.

In some exemplary embodiments, the first array defines a first axis along which the transmit antenna patches are disposed, and the second array defines a second axis along which the receive antenna patches are disposed, the spatial orientation being selected such that the first and second axes are substantially nonparallel. At least one of the transmit antenna patches can include a first side edge facing the second array, and at least one of the receive antenna patches can include a second side edge facing the first array, the spatial orientation being selected such that the first and second side edges are substantially parallel.

In some exemplary embodiments, the substantially nonparallel first and second axes define a tilt angle defining an angular orientation between the first and second axes. The tilt angle is in a range of 2.0 to 5.0 degrees, and can be, for example, 2.5 degrees.

In some exemplary embodiments, the antenna further comprises a first plurality of conductive lines, each of the first plurality of conductive lines connecting a pair of adjacent transmit antenna patches, and a second plurality of conductive lines, each of the second plurality of conductive lines connecting a pair of adjacent receive antenna patches. At least one of the first plurality of conductive lines can be substantially nonparallel to at least one of the second plurality of conductive lines. At least one of the transmit antenna patches can include a first side edge facing the second array, and at least one of the first plurality of conductive lines is substantially nonparallel to the first side edge. At least one of the receive antenna patches can include a first side edge facing the first array, and at least one of the second plurality of conductive lines is substantially nonparallel to the first side edge.

In some exemplary embodiments, the antenna is part of a radar sensor.

In some exemplary embodiments, the antenna is part of an automotive radar sensor.

In some exemplary embodiments, the antenna further comprises a second array of transmit antenna patches.

In some exemplary embodiments, the antenna further comprises a second array of receive antenna patches.

BRIEF DESCRIPTION OF THE DRAWINGS

The present disclosure is further described in the detailed description which follows, in reference to the noted plurality of drawings by way of non-limiting examples of embodiments of the present disclosure, in which like reference numerals represent similar parts throughout the several views of the drawings.

DETAILED DESCRIPTION

Figure 1:
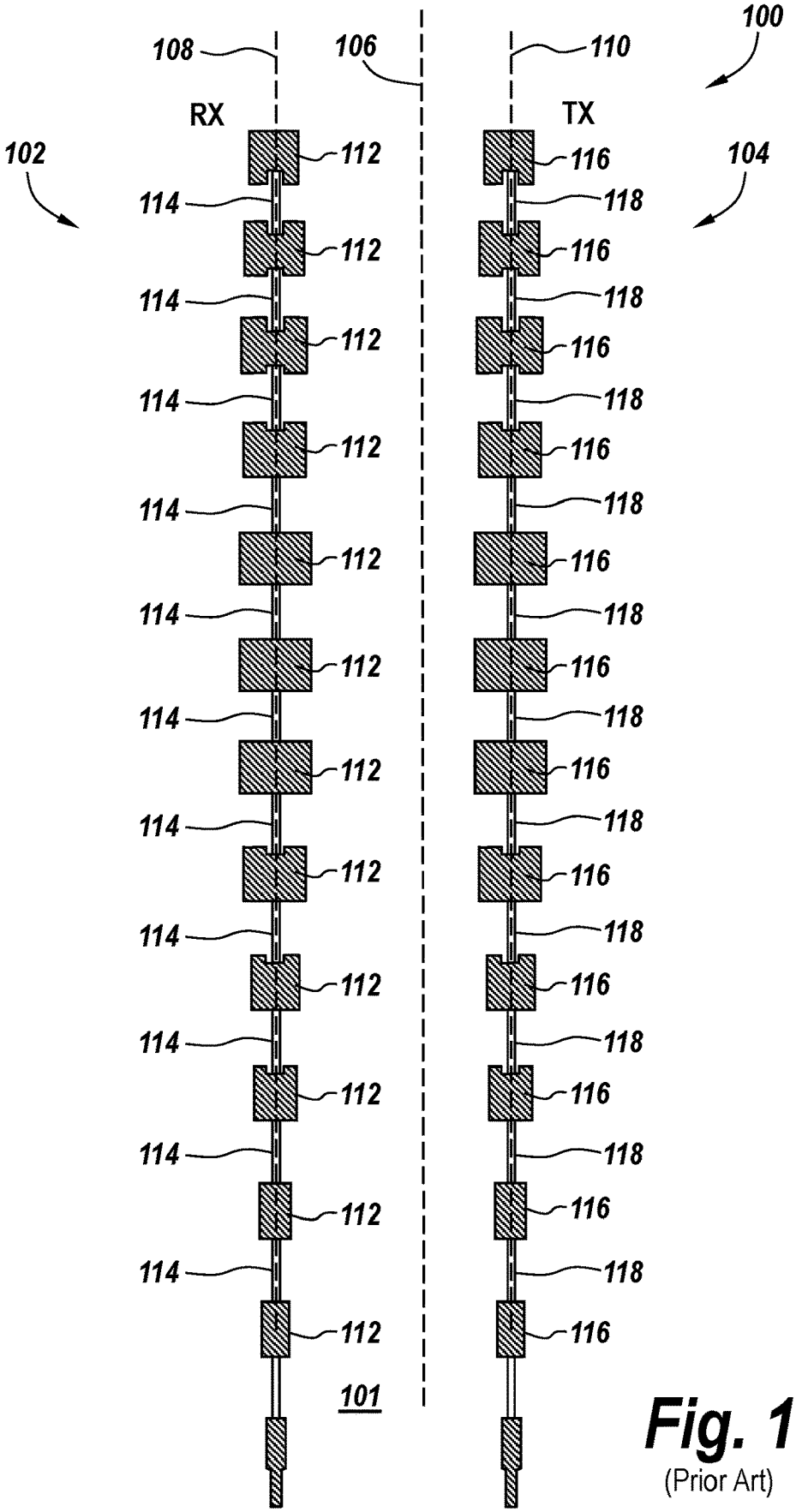
Fig. 1 (Prior Art)
FIG. 1 includes a schematic top view of a conventional planar antenna structure for an automotive radar sensor, according to prior art.

FIG. 1 includes a schematic top view of a conventional planar antenna structure for an automotive radar sensor, according to prior art. Referring to FIG. 1, planar antenna structure 100 includes at least one transmit Tx array 104 and at least one Rx array 102. Rx array 102 includes a plurality of conductive patches 112 formed on a substrate 101, e.g., a PCB. Adjacent patches 112 are interconnected by conductive microstrip line segments 114, also formed on substrate 101. Similarly, Tx array 104 includes a plurality of conductive patches 116 formed on substrate 101, e.g., a PCB. Adjacent patches 116 are interconnected by conductive microstrip line segments 118, also formed on substrate 101.

Planar antenna structure 100 can extend along a longitudinal reference direction or longitudinal reference axis 106 indicated by a dashed line in FIG. 1. Each of Rx array 102 and Tx array 104 can also be considered to extend along its own longitudinal direction or longitudinal axis 108 and 110, respectively. As illustrated in FIG. 1, in the conventional planar antenna structure 100, the Rx array 102 and Tx array 104 extend in parallel. That is, longitudinal axis 108 of Rx array 102 is substantially parallel to longitudinal axis 110 of Tx array 104. Furthermore, both longitudinal axes 108 and 110 are parallel to longitudinal reference axis 106 of planar antenna structure 100.

One drawback to planar antenna systems such as system 100 is that there exists some amount of undesirable coupling between Tx array 104 and Rx array 102. For example, target illumination energy emitted from Tx array 102 can be coupled to Rx array 102. This can result in a degradation in performance of the antenna arrays 102 and 104, in the planar antenna structure 100, and, therefore in the radar sensor itself. As demands for space increase, the distance between antenna arrays 102 and 104 must be made increasing smaller, which further exacerbates the problem with coupling between the arrays 102 and 104.

It has been shown that the coupling between neighboring substrate patch antennas, such as Rx array 102 and Tx array 104, cannot be reduced by placing electromagnetic obstacles in the space between the patch arrays. In fact, in many cases, such obstacle actually result in increased coupling.

Other alternatives to reducing coupling can include using antennas of different types, i.e., two different patch patterns for Tx and Rx antenna arrays, such as different shape and/or size of patches and/or different overall length of the arrays. However, it has been shown that this approach only reduces coupling in the second order. The reason for this is that, for example, in a horizontal polarization, a quasi-plane wave is generated and propagates guided by the substrate toward the second antenna array. If both antennas radiate in the same elevation direction, this travelling wave perfectly couples into the second antenna, dependent only weakly on the particular antenna design. Patch antenna structure 100 of FIG. 1 includes a signal Rx array 104 and a single Rx array 102 designed to transmit or receive at elevation boresight. All Tx patches 116 radiate at the same phase. As a result, a plane wave with a phase front parallel to longitudinal axis 110 of Tx array 104 propagates toward Rx array 102, where all patches 112 are excited in phase, leading to a high level of undesired coupling.

Figure 2:
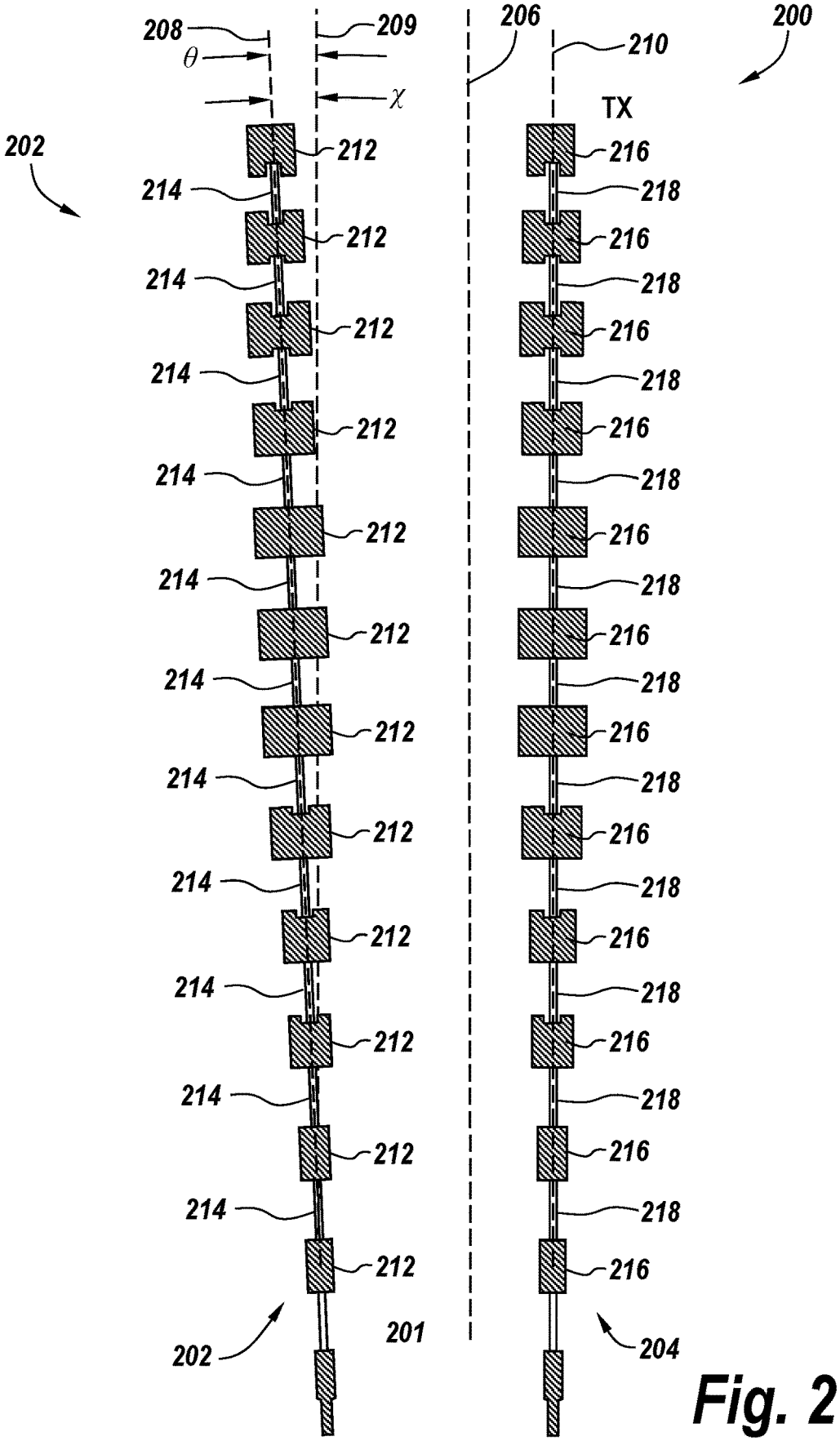
FIG. 2 includes a schematic top view of a planar antenna structure for an automotive radar sensor, according to some exemplary embodiments.

According to the present disclosure, coupling between a Tx array and a Rx array is reduced by positioning the arrays such that their longitudinal axes are not parallel, but, rather, are oblique, or "tilted," with respect to each other. FIG. 2 includes a schematic top view of a planar antenna structure for an automotive radar sensor, according to some exemplary embodiments. In planar antenna structure 200 of FIG. 2, in contrast to planar antenna structure 100 of FIG. 1, Rx array 202 and Tx array 204 are not parallel, but, rather, are tilted or oblique with respect to each other. As a result of this tilt, coupling between Tx array 204 and Rx array 202 is substantially reduced, resulting in improved sensor performance.

Referring to FIG. 2, planar antenna structure 200 includes at least one transmit Tx array 204 and at least one Rx array 202. Rx array 202 includes a plurality of conductive patches 212 formed on a substrate 201, e.g., a PCB. Adjacent patches 212 are interconnected by conductive microstrip line segments 214, also formed on substrate 201. Similarly, Tx array 204 includes a plurality of conductive patches 216 formed on substrate 201, e.g., a PCB. Adjacent patches 216 are interconnected by conductive microstrip line segments 218, also formed on substrate 201.

Planar antenna structure 200 can extend along a longitudinal reference direction or longitudinal reference axis 206 indicated by a dashed line in FIG. 2. Each of Rx array 202 and Tx array 204 can also be considered to extend along its own longitudinal direction or longitudinal axis 208 and 210, respectively. As illustrated in FIG. 2, in the planar antenna structure 200 of the exemplary embodiments, the Rx array 202 and Tx array 204 do not extend in parallel. That is, longitudinal axis 208 of Rx array 202 is tilted or oriented at an angle with respect to longitudinal axis 210 of Tx array 204. Furthermore, in some exemplary embodiments, one of axes 208 and 210 is substantially parallel to longitudinal reference axis 206 of planar antenna structure 200. In the illustration of FIG. 2, longitudinal axis 210 of Tx array 204 is substantially parallel to longitudinal reference axis 206 of planar antenna structure 200.

In the embodiment illustrated in FIG. 2, Rx array 202 is tilted with respect to the orientation parallel to longitudinal reference axis 206, which orientation is illustrated by dashed line 209. In some exemplary embodiments, this tilt defines an angle $\theta$ in the range of 2.0-5.0 degrees, and, in some particular exemplary embodiments, is 2.5 degrees, which results in a displacement distance x, at an end of Rx array 202, as shown in FIG. 2.

Figure 3:
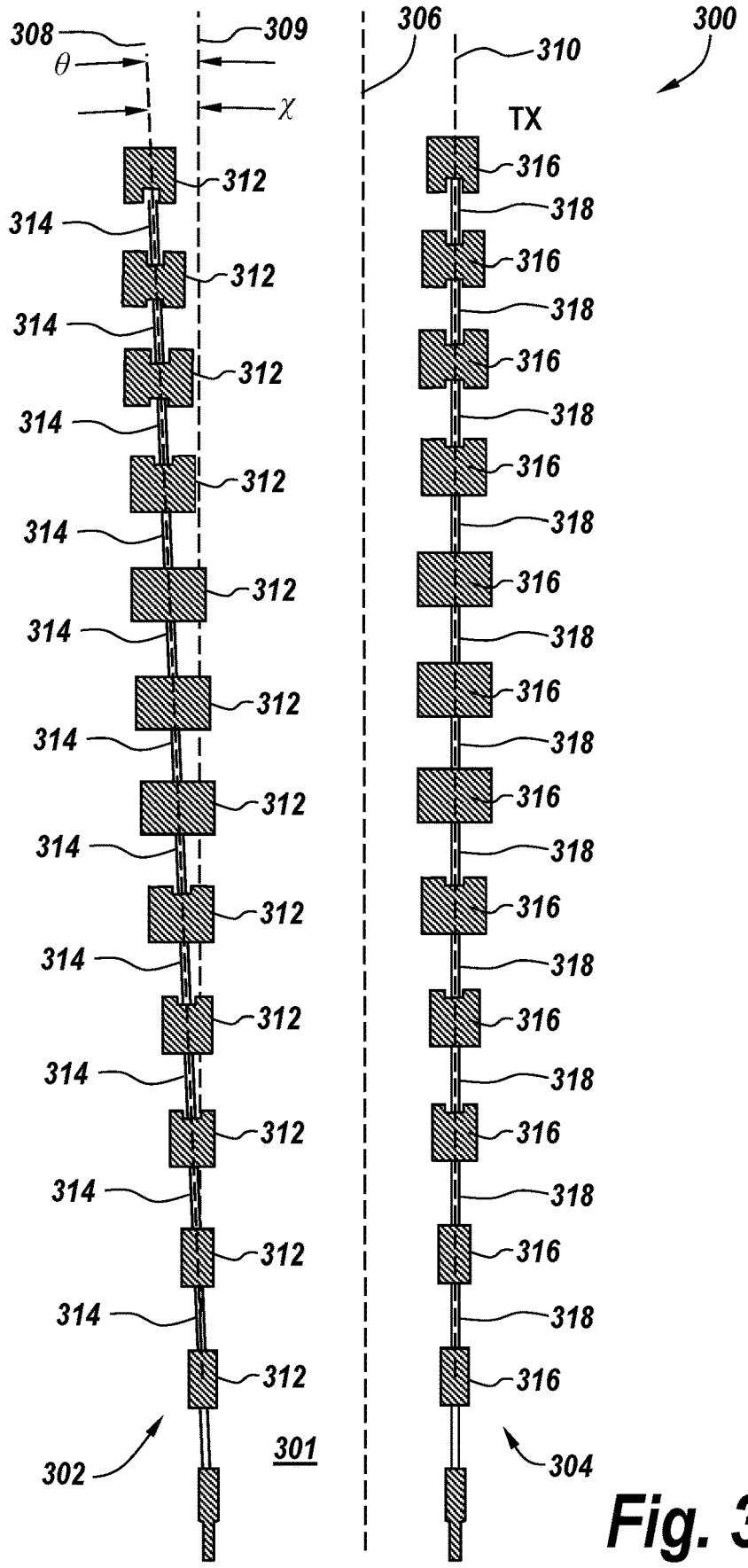
FIG. 3 includes a schematic top view of another planar antenna structure for an automotive radar sensor, according to some exemplary embodiments.

In the embodiment of FIG. 2, the entirety of Rx array 202 is rotated as a unit to create the tilt with respect to Tx array 204. That is, the orientation of each of the patches 212 is rotated counterclockwise to maintain its spatial orientation with respect to all of the other patches 212 and microstrip line segments 214. As a result, the edges of patches 212 that face Tx array 204 are not parallel to longitudinal axis 210, but are tilted with respect to longitudinal axis 210. As a result, the polarization of the two antenna arrays 202 and 204 is different, which results in a reduction in the link budget. FIG. 3 illustrates a planar antenna structure in which this situation is eliminated.

FIG. 3 includes a schematic top view of another planar antenna structure for an automotive radar sensor, according to some exemplary embodiments. Referring to FIG. 3, planar antenna structure 300 includes at least one transmit Tx array 304 and at least one Rx array 302. Rx array 302 includes a plurality of conductive patches 312 formed on a substrate 301, e.g., a PCB. Adjacent patches 312 are interconnected by conductive microstrip line segments 314, also formed on substrate 301. Similarly, Tx array 304 includes a plurality of conductive patches 316 formed on substrate 301, e.g., a PCB. Adjacent patches 316 are interconnected by conductive microstrip line segments 318, also formed on substrate 301.

Planar antenna structure 300 can extend along a longitudinal reference direction or longitudinal reference axis 306 indicated by a dashed line in FIG. 3. Each of Rx array 302 and Tx array 304 can also be considered to extend along its own longitudinal direction or longitudinal axis 308 and 310, respectively. As illustrated in FIG. 3, in the planar antenna structure 300 of the exemplary embodiments, the Rx array 302 and Tx array 304 do not extend in parallel. That is, longitudinal axis 308 of Rx array 302 is tilted or oriented at an angle with respect to longitudinal axis 310 of Tx array 304. Furthermore, in some exemplary embodiments, one of axes 308 and 310 is substantially parallel to longitudinal reference axis 306 of planar antenna structure 300. In the illustration of FIG. 3, longitudinal axis 310 of Tx array 304 is substantially parallel to longitudinal reference axis 306 of planar antenna structure 300.

In the embodiment illustrated in FIG. 3, Rx array 302 is tilted with respect to the orientation parallel to longitudinal reference axis 206, which orientation is illustrated by dashed line 309. In some exemplary embodiments, this tilt defines an angle θ in the range of 2.0-5.0 degrees, and, in some particular exemplary embodiments, is 2.5 degrees, which results in a displacement distance x, at an end of Rx array 302, as shown in FIG. 3.

As noted above, in planar antenna system 200 of FIG. 2, the entirety of Rx array 202 is rotated as a unit to create the tilt with respect to Tx array 204. As a result, the edges of patches 212 that face Tx array 204 are not parallel to longitudinal axis 210, but are tilted with respect to longitudinal axis 210. As a result, the polarization of the two antenna arrays 202 and 204 is different, which results in a reduction in the link budget. In contrast, in planar antenna structure 300 of FIG. 3, patches 312 of Rx array 302 are not rotated, such that their edges facing Tx array 304 are substantially parallel to longitudinal axis 310 of Tx array 304. With this orientation, both antenna arrays 302 and 304 radiate at boresight and at the same polarization. However, since the orientation of all patches 312 and 316 are all the same, the link budget is not reduced due to a difference in polarization (cross-polarization).

The present disclosure is applicable to decoupling Tx and Rx arrays, regardless of whether the antennas are radiating at boresight or other angles. In general, besides the antennas, there are many factors that affect the overall performance of the radar sensor, such as the radome, packaging, installation setup, position with respect to the vehicle bumper, and other factors, the effects of which will be impacted by polarization of the radiated wave. For each case, according to the present disclosure, such parameters are optimized for certain polarizations. In the case of current sensors being vertically polarized, it is desirable to maximize co-polarized radiation (vertical) and minimize cross-polarizations (horizontal), to avoid undesired effects of the interactions of such waves with sensor components which would negatively affecting overall performance of the sensor. As described above, this also contributes to the reduction of link budget due to sending out energy at polarizations at which the antenna and overall sensor performance are not optimized to perform (cross-polarization). It is noted that the current disclosure is also applicable to configurations in which co-polarization is horizontal and hence cross-polarization is vertical.

Figure 4:
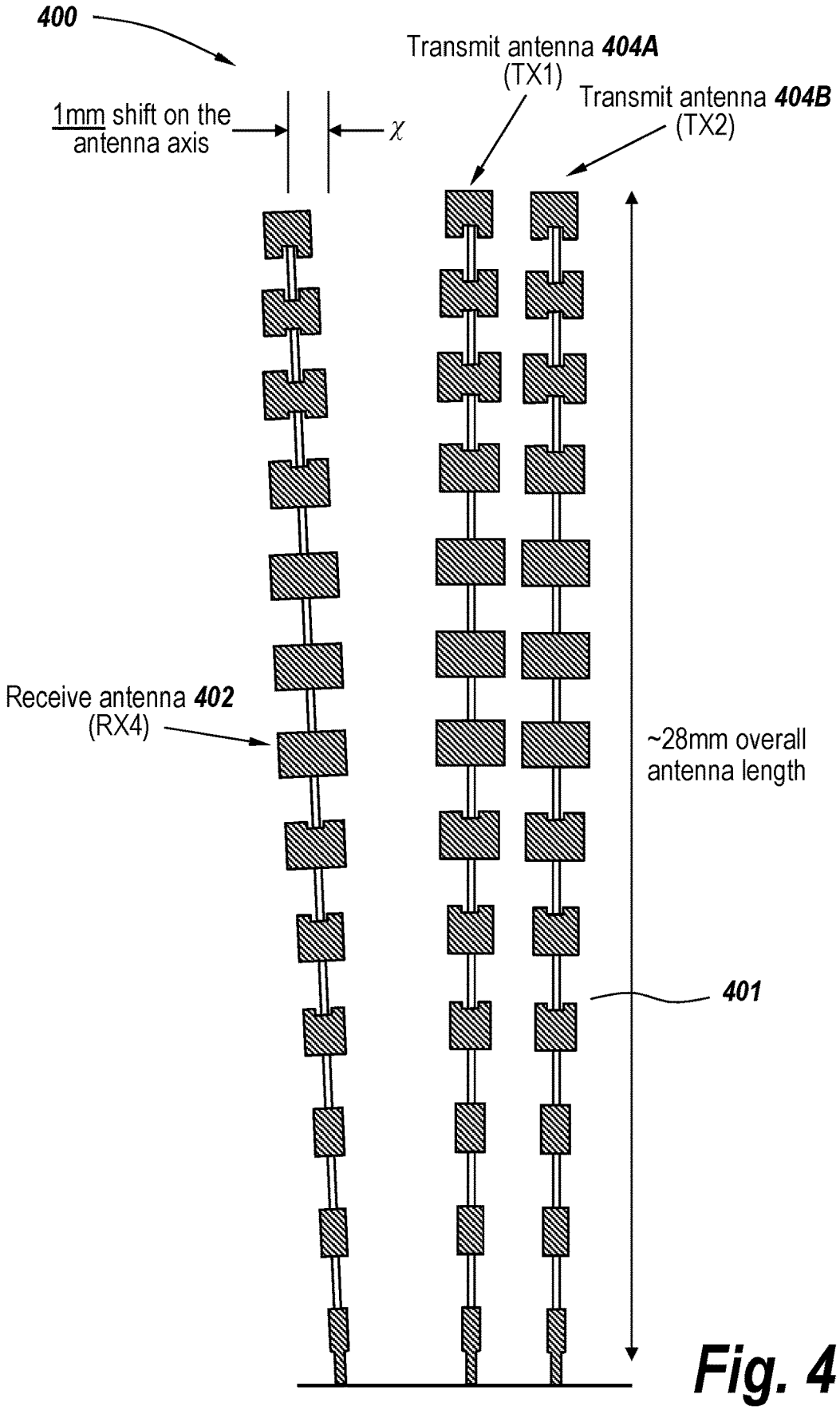
FIG. 4 includes a schematic top view of another planar antenna structure for an automotive radar sensor, according to some exemplary embodiments.
Figure 5A:
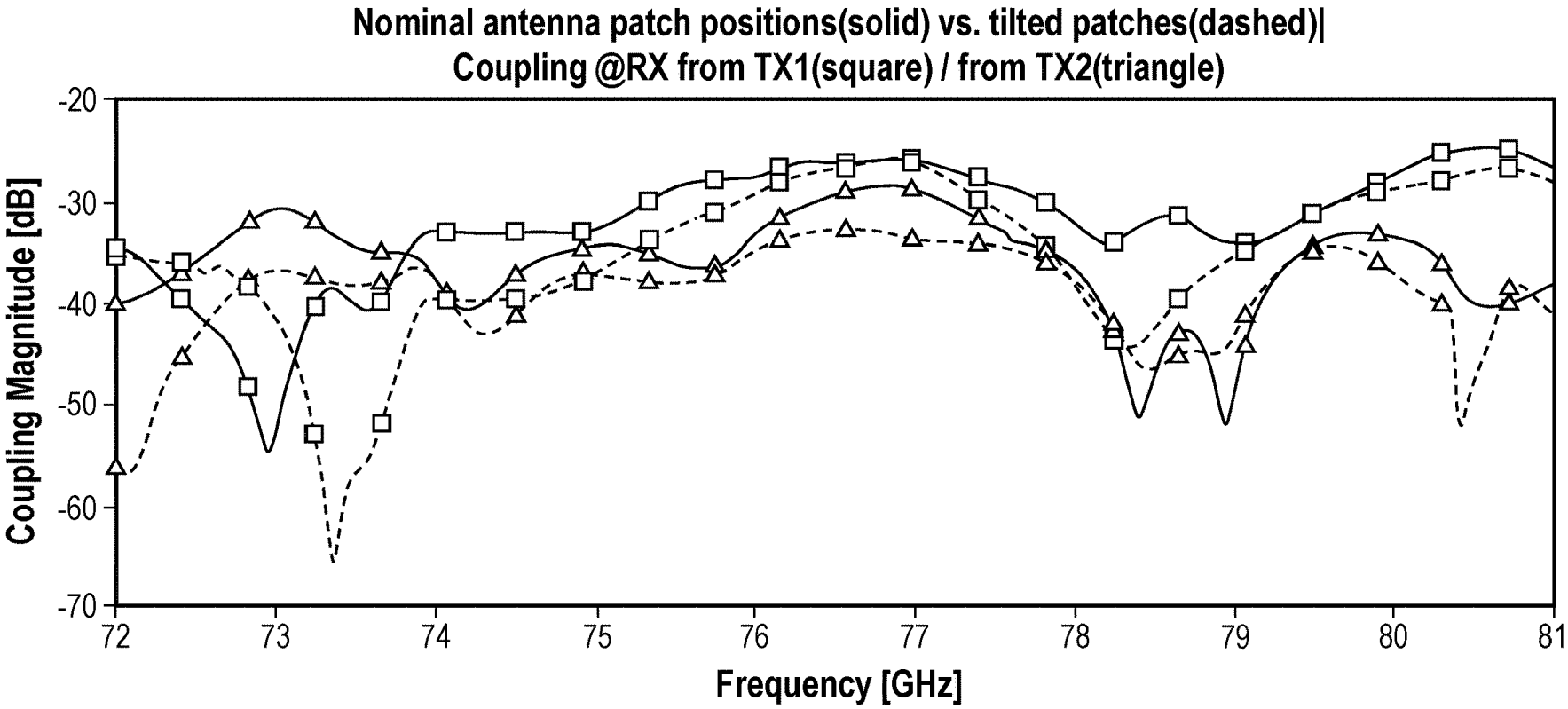
FIG. 5A includes a graph generated from simulation of the planar antenna structure of FIG. 4, illustrating the direct coupling over frequency in GHz from the two adjacent transmitting antenna arrays Tx1 and Tx2 in the planar antenna structure of FIG. 4, at the receiving Rx antenna array Rx4.
Figure 5B:
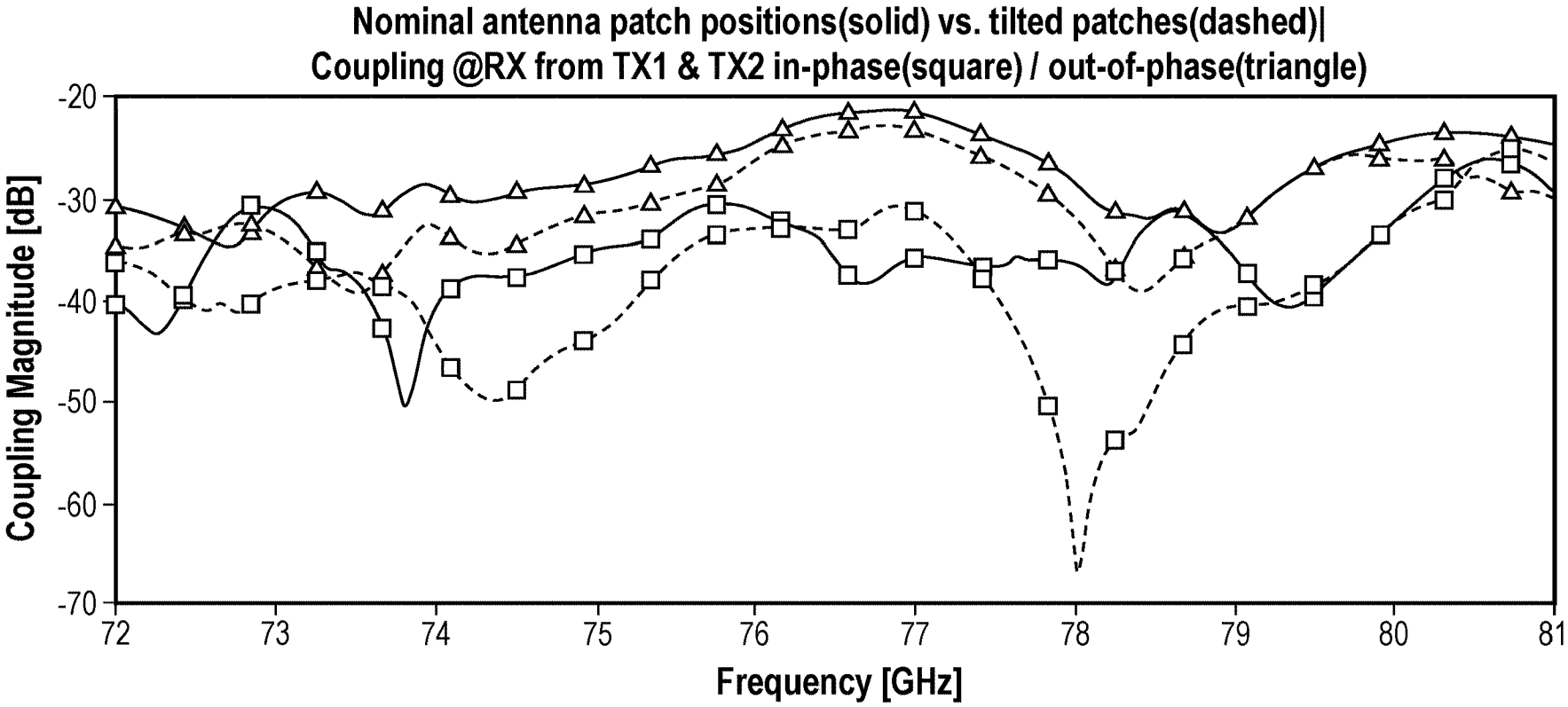
FIG. 5B includes a graph generated from simulation of the planar antenna structure of FIG. 4, illustrating the coupling over frequency in GHz from the two adjacent transmitting antenna arrays Tx1 and Tx2 in the planar antenna structure of FIG. 4, at the receiving Rx antenna array Rx4.
Figure 6A:
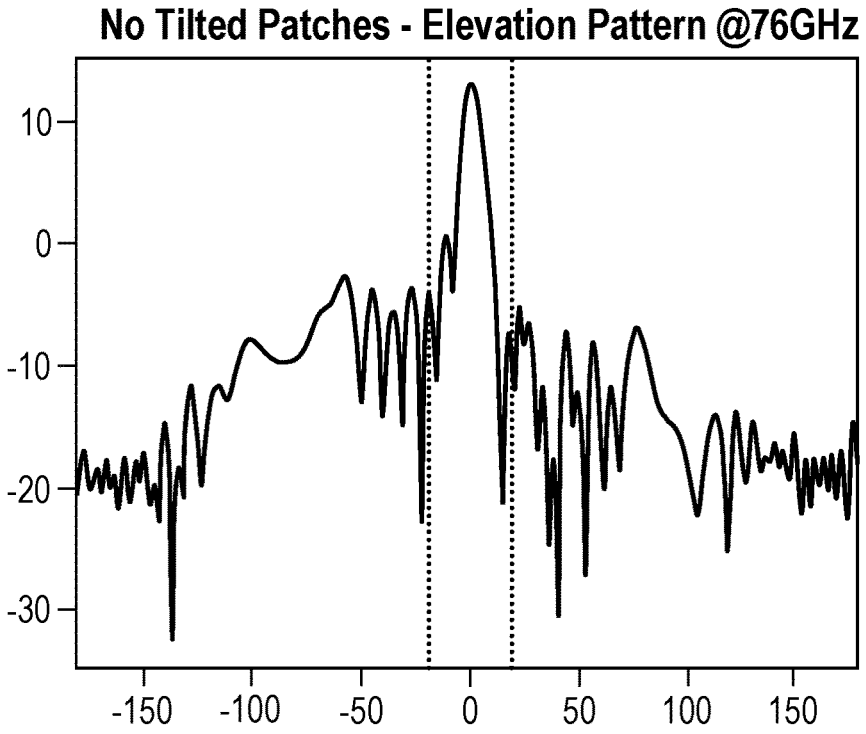
FIGS. 6A through 6F include elevation pattern graphs generated from simulation of the planar antenna system of FIG. 4, for the conventional straight (non-tilted) configuration and tilted configuration, for three frequencies, namely, 76 GHz, 76.5 GHz and 77 GHz.
Figure 6B:
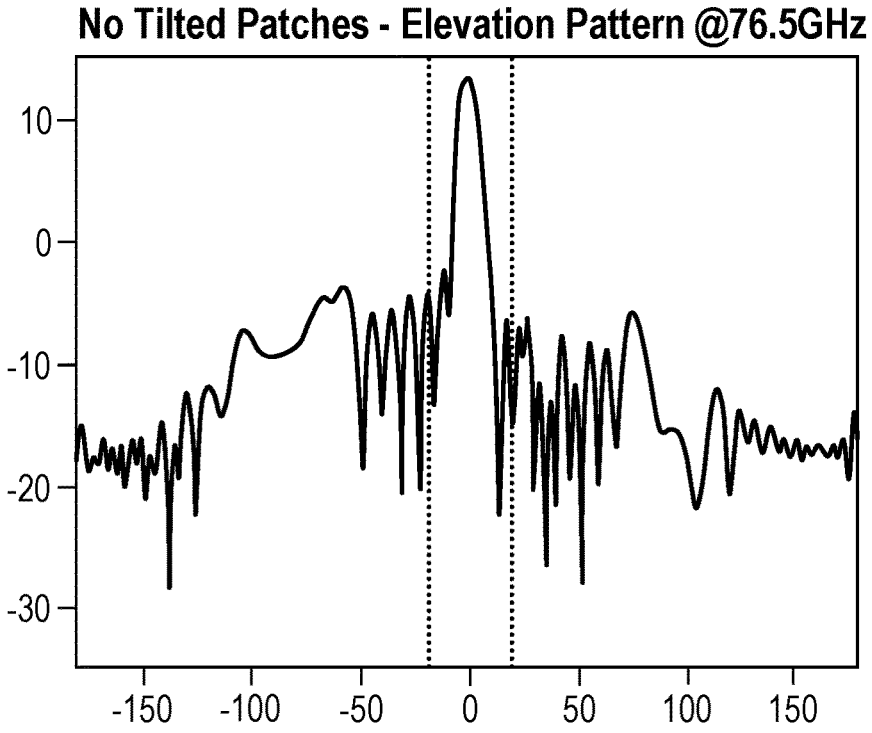
Figure 6C:
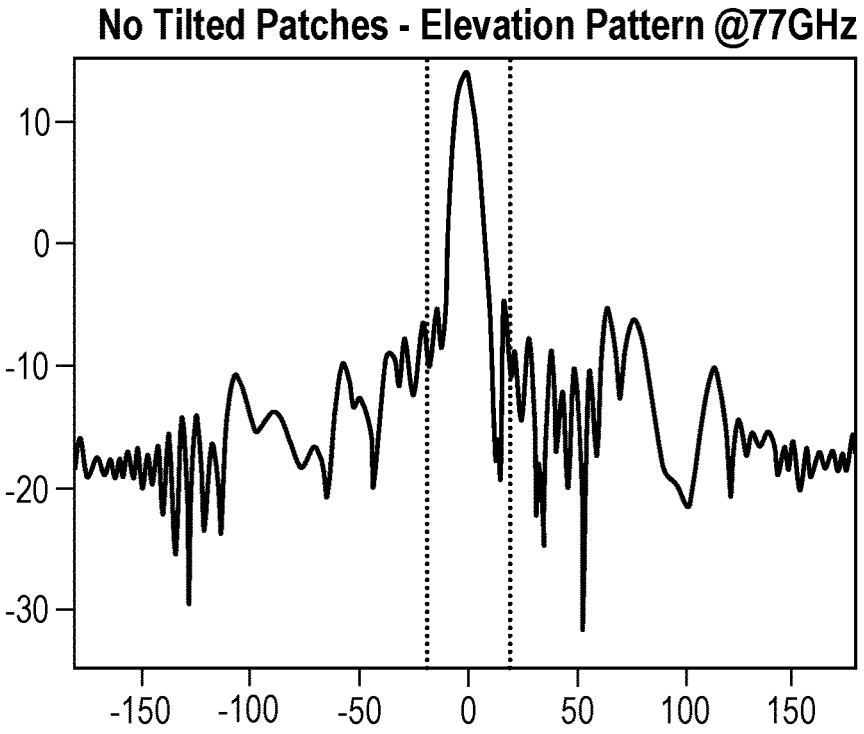
Figure 6D:
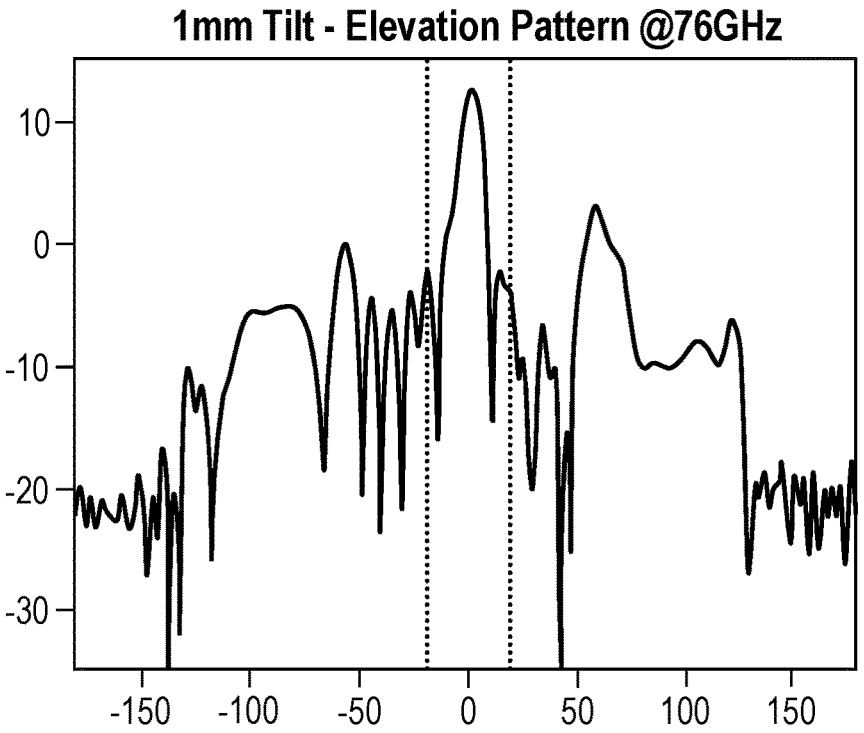
Figure 6E:
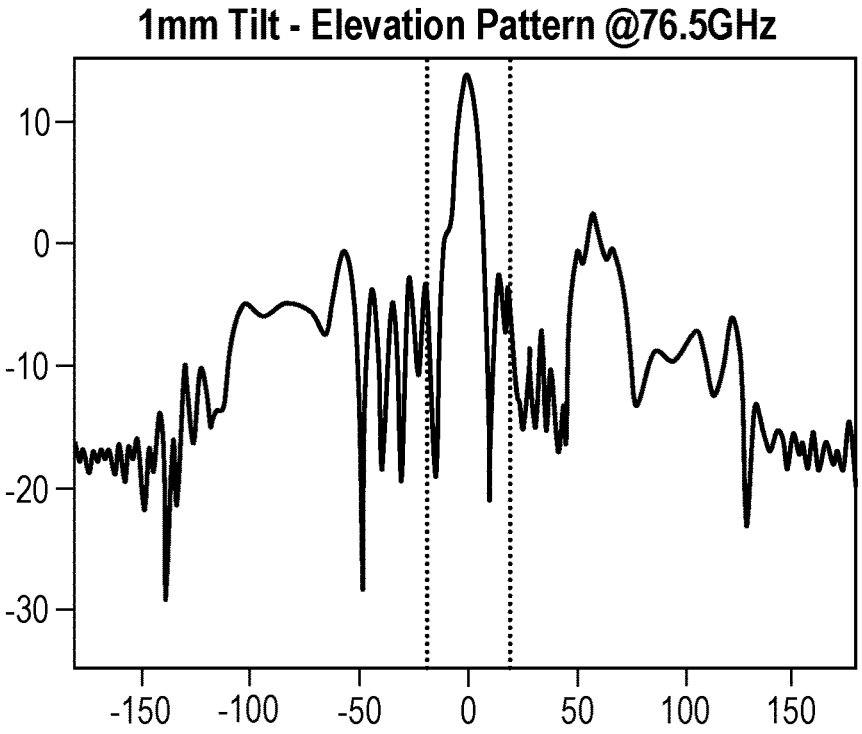
Figure 6F:
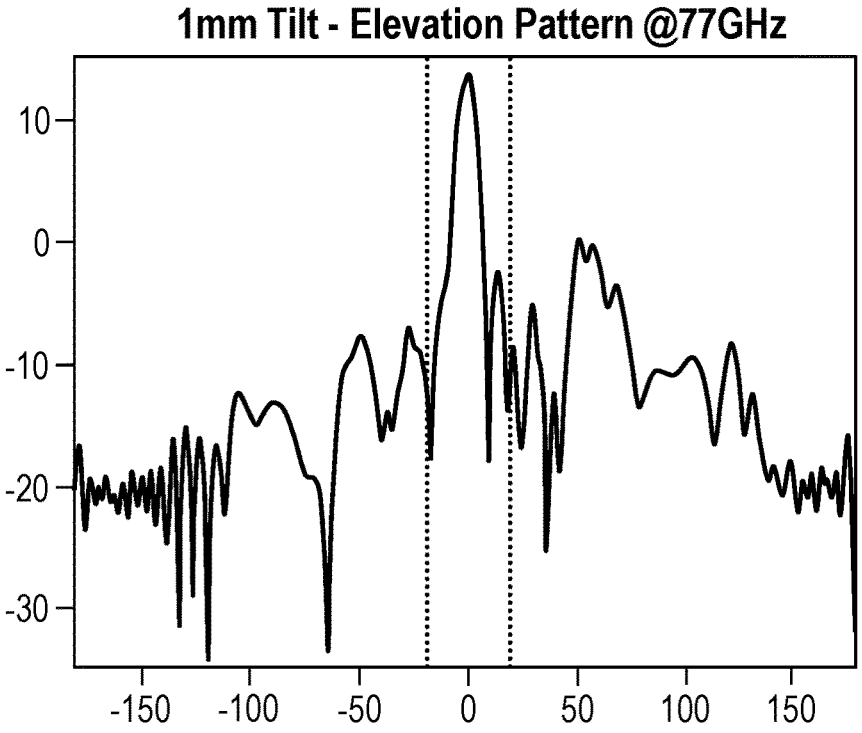

FIG. 4 includes a schematic top view of another planar antenna structure for an automotive radar sensor, according to some exemplary embodiments. FIG. 5A includes a graph generated from simulation of the planar antenna structure of FIG. 4, illustrating the direct coupling over frequency in GHz from the two adjacent transmitting antenna arrays Tx1 and Tx2 in the planar antenna structure of FIG. 4 at the receiving Rx antenna array Rx4. In FIG. 5A, solid lines indicate the straight (non-tilted) case for Tx1 (marked with squares) and Tx2 (marked with triangles), and dashed lines indicate the tilted case for Tx1 (marked with squares) and Tx2 (marked with triangles). FIG. 5B includes a graph generated from simulation of the planar antenna structure of FIG. 4, illustrating the coupling over frequency in GHz from the two adjacent transmitting antenna arrays Tx1 and Tx2 in the planar antenna structure of FIG. 4 at the receiving Rx antenna array Rx4. In FIG. 5B, solid lines indicate the straight (non-tilted) case, and dashed lines indicate the tilted case. FIG. 5B illustrates the combined in phase (marked with squares) and out of phase (marked with triangles) coupling from Tx1 and Tx2 at Rx4. FIGS. 6A through 6F include elevation pattern graphs generated from simulation of the planar antenna system of FIG. 4, for the conventional straight (non-tilted) configuration and tilted configuration, for three frequencies, namely, 76 GHz, 76.5 GHz and 77 GHz.

Referring to FIGS. 4, 5A, 5B, and 6A-6B, planar antenna structure 400 includes a Rx array 402 (Rx4) and two Tx arrays 404A and 404B formed on substrate 401. Rx array 402 (Rx4) is tilted according to the present disclosure to create a displacement or shift x at the end of the array, as shown. In the particular exemplary illustration of FIG. 4, planar antenna structure 400 has a nominal length of approximately 28 mm. The tilt shown in FIG. 4 results in a nominal displacement x of approximately 1 mm. As shown in the graphs of FIGS. 5A and 5B, the tilt of Rx array 402 (Rx4), without any significant change in any other aspects of the design layout and circuity, provides on average about 3 dB reduction in coupling within the frequency band of interest (76-77 GHz). This is achieved without alteration of antenna patterns, as illustrated in FIGS. 6A-6F, while improving almost all antenna performance features. FIGS. 6A-6F illustrate that while reducing coupling between transmit and receive antennas, the effect of the tilting of the present disclosure on antenna patterns, especially within the frequency range of interest, is negligible, if not slightly improved.

In the embodiments of planar antenna structures illustrated and described herein, coupling between planar antenna arrays is reduced for difference polarization schemes, such as vertical polarization and horizontal polarization. The approach of the disclosure is particularly helpful in the case of horizontal polarization, since for those antennas, the coupling is typically stronger. The planar antenna structures illustrated and described herein refer to antenna arrays radiating and/or receiving at boresight. It will be understood that the disclosure is applicable to other angles as well. In some exemplary embodiments, Tx1 and Tx2 are excited at the same time in-phase (sum pattern, radiating and boresight) and out-of-phase (delta pattern with minimized radiation at boresight). In some cases, the coupling levels are often higher for the delta pattern case, and the approach of the disclosure helps significantly to reduce such high coupling between adjacent Tx and Rx antennas in both delta radiation mode and the sum mode.

Figure 7:
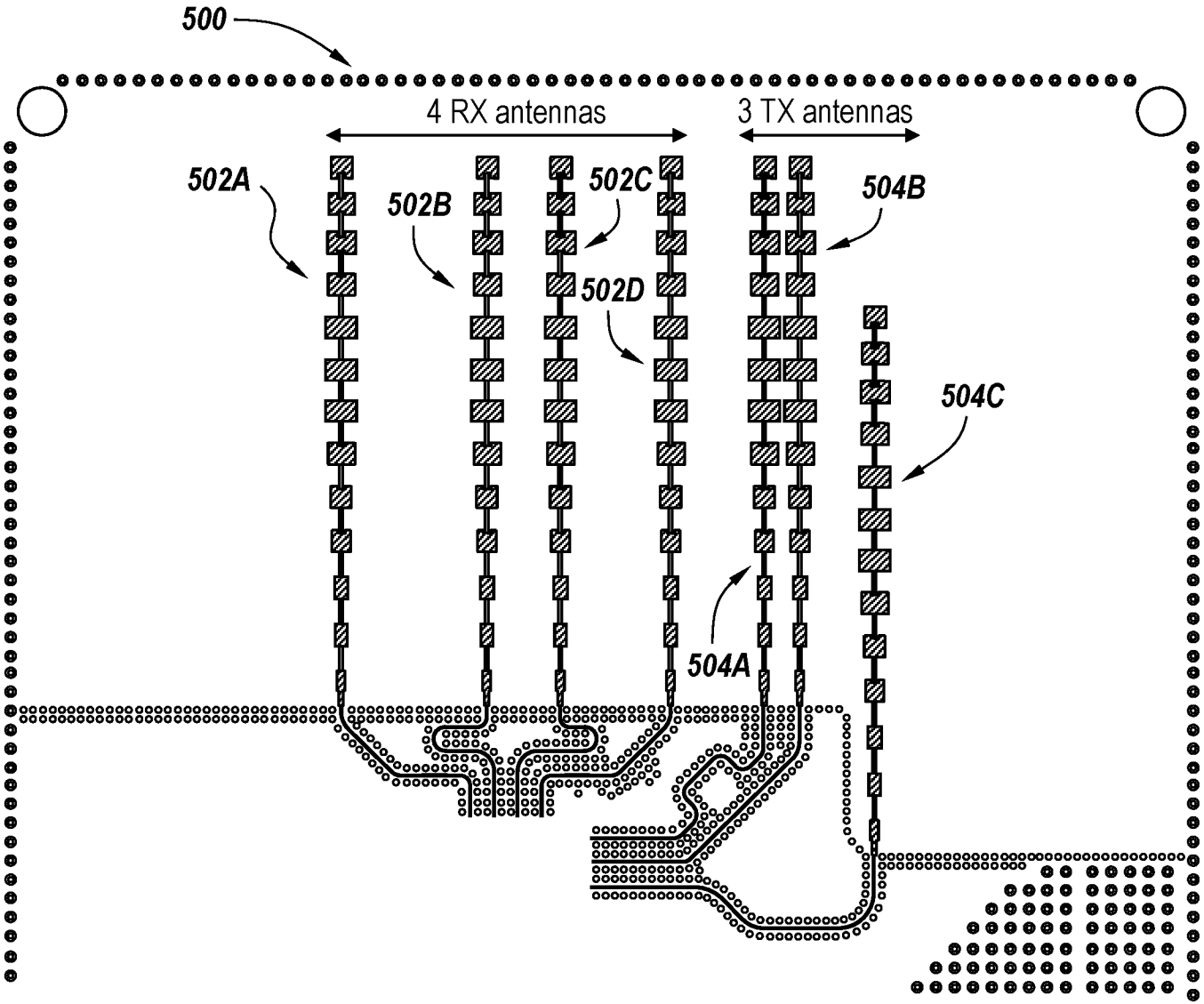
FIG. 7 includes a schematic top view of another planar antenna structure for an automotive radar sensor, according to some exemplary embodiments.

The present disclosure is applicable to antenna structures with any number of Rx and Tx arrays. FIG. 7 includes a schematic top view of another planar antenna structure 500 for an automotive radar sensor, according to some exemplary embodiments. Referring to FIG. 7, planar antenna structure 500 includes four Rx arrays 502A, 502B, 502C, and 502D. Planar antenna structure 500 also includes three Tx arrays 504A, 504B, and 504C. According to the disclosure, the issue of high coupling is highly pronounced and problematic between the adjacent Rx and Tx antenna arrays, i.e., Rx array 502D and Tx array 504A, and the decoupling of the disclosure is best achieved by applying the tilt configuration to one or more of those adjacent arrays. However, it will be understood that applying the techniques of the present disclosure will also reduce the coupling between any or all of the Tx arrays 504A, 504B, and 504C and any or all of Rx arrays 502A, 502B, 502C, and 502D. This is applicable to any of the embodiments of planar antenna structures illustrated and described herein.

Whereas many alterations and modifications of the disclosure will become apparent to a person of ordinary skill in the art after having read the foregoing description, it is to be understood that the particular embodiments shown and described by way of illustration are in no way intended to be considered limiting. Further, the subject matter has been described with reference to particular embodiments, but variations within the spirit and scope of the disclosure will occur to those skilled in the art. It is noted that the foregoing examples have been provided merely for the purpose of explanation and are in no way to be construed as limiting of the present disclosure.

While the present inventive concept has been particularly shown and described with reference to exemplary embodiments thereof, it will be understood by those of ordinary skill in the art that various changes in form and details may be made therein without departing from the spirit and scope of the present inventive concept as defined by the following claims.

The invention claimed is:

1. An antenna, comprising:

a substrate having a planar surface defining a plane;

a first planar array of transmit antenna patches on the planar surface of the substrate in the plane, the transmit antenna patches being disposed along a longitudinal axis of the first planar array; and a second planar array of receive antenna patches on the planar surface of the substrate in the plane, the receive antenna patches being disposed along a longitudinal axis of the second planar array; wherein a spatial orientation of the first planar array with respect to the second planar array is such that the longitudinal axis of the first planar array and the longitudinal axis of the second planar array are substantially nonparallel and define a tilt angle defining an angular orientation between them within the plane, the angular orientation being selected based on a desired radiation coupling between the first array and the second array; and at least one of the transmit antenna patches comprises a first side edge facing the second planar array, and at least one of the receive antenna patches comprises a second side edge facing the first planar array, the spatial orientation being selected such that the first and second side edges are substantially parallel.

2. The antenna of claim 1, wherein the angular orientation between the longitudinal axis of the first planar array and the longitudinal axis of the second planar array is selected to reduce the radiation coupling between the first array and the second array.

3. The antenna of claim 1, wherein the tilt angle is in a range of 2.0 to 5.0 degrees.

4. The antenna of claim 3, wherein at least one of the transmit antenna patches comprises a first side edge facing the second planar array, and at least one of the first plurality of conductive lines is substantially nonparallel to the first side edge.

5. The antenna of claim 3, wherein at least one of the receive antenna patches comprises a first side edge facing the first planar array, and at least one of the second plurality of conductive lines is substantially nonparallel to the first side edge.

6. The antenna of claim 1, wherein the tilt angle is 2.5 degrees.

7. The antenna of claim 1, further comprising:

a first plurality of conductive lines, each of the first plurality of conductive lines connecting a pair of adjacent transmit antenna patches; and a second plurality of conductive lines, each of the second plurality of conductive lines connecting a pair of adjacent receive antenna patches.

8. The antenna of claim 7, wherein at least one of the first plurality of conductive lines is substantially nonparallel to at least one of the second plurality of conductive lines.

9. The antenna of claim 1, wherein the antenna is part of a radar sensor.

10. The antenna of claim 1, wherein the antenna is part of an automotive radar sensor.

11. The antenna of claim 1, further comprising a second planar array of transmit antenna patches.

12. The antenna of claim 1, further comprising a second planar array of receive antenna patches.

* * * * *